US006253451B1

(12) United States Patent
Semmeling et al.

(10) Patent No.: US 6,253,451 B1
(45) **Date of Patent: *Jul. 3, 2001**

(54) METHOD FOR MOUNTING A PANEL-LIKE DEVICE ON A PRINTED CIRCUIT BOARD

(75) Inventors: Ralph A. E. M. Semmeling; Andrew G. Meller, both of Vlijmen (NL)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,061

(22) Filed: Mar. 10, 1999

Related U.S. Application Data

(62) Division of application No. 09/001,971, filed on Dec. 31, 1997

(60) Provisional application No. 60/042,360, filed on Mar. 26, 1997.

(51) Int. Cl.[7] ..... H01K 9/00

(52) U.S. Cl. ..... 29/842; 29/843; 29/876; 29/881; 29/884; 439/65

(58) Field of Search ..... 29/884, 842, 843, 29/876, 881; 439/65

(56) References Cited

U.S. PATENT DOCUMENTS

| | | | | |
|---|---|---|---|---|
| 3,631,380 | | 12/1971 | Bohn . | |
| 3,715,706 | | 2/1973 | Michel et al. . | |
| 4,003,625 | | 1/1977 | Vladie . | |
| 4,057,311 | * | 11/1977 | Evans | 439/66 |
| 4,185,882 | | 1/1980 | Johnson . | |
| 4,357,061 | | 11/1982 | Crosby . | |
| 4,547,964 | | 10/1985 | Amano et al. . | |
| 4,738,625 | | 4/1988 | Burton et al. . | |
| 5,259,769 | | 11/1993 | Cruise et al. . | |
| 5,358,412 | | 10/1994 | Maurinus et al. . | |
| 5,588,844 | | 12/1996 | Sipe . | |
| 5,722,861 | * | 3/1998 | Wetter . | |
| 5,746,607 | | 5/1998 | Bricaud et al. . | |
| 6,003,226 | * | 12/1999 | Patel et al. | 29/842 X |

* cited by examiner

*Primary Examiner*—Lee Young
*Assistant Examiner*—Rick Kiltae Chang
(74) *Attorney, Agent, or Firm*—Brian J. Hamilla; M. Richard Page

(57) ABSTRACT

An electrical connector which includes an insulative body which has a leg portion and a top portion which extends generally perpendicularly from the leg second portion. A conductive contact which includes a retention section and a resilient section is also included in the electrical connector. The contact is fixed to the top section and the resilient section extends along the leg section. The connector may be interposed between a electrical device and a printed circuit board.

20 Claims, 7 Drawing Sheets

METHOD FOR MOUNTING A PANEL-LIKE DEVICE ON A PRINTED CIRCUIT BOARD

CROSS-REFERENCE TO RELATED APPLICATIONS

This application is a divisional of U.S. patent application Ser. No. 09/001,971, filed on Dec. 31, 1997, and claims the benefit of U.S. Provisional Patent Application No. 60/042,360, filed on Mar. 26, 1997, both of which are herein incorporated by reference.

BACKGROUND OF THE INVENTION

1. Field of the Invention

This invention relates to electrical connectors and particularly to printed circuit board connectors.

2. Brief Description of Prior Developments

Electrical connectors for connecting small panel-like electrical devices, such as circuit boards or liquid crystal displays (LCD) to another circuit board are known. One such connector employs an insulative body having a slot for receiving an LCD module. A linear array of connector terminals are mounted on the body. The spring portions disposed at one end of the terminals are located along the slot to engage circuit contact pads on the LCD. The other ends of the terminals are wrapped about the connector body and extend in a fixed position along a bottom edge of the connector body to form bottom contacts. Because the bottom contacts have no compliance, it is necessary to utilize a sheet of elastomeric material between the bottom of the connector body and the circuit board. The elastomeric body is provided with appropriate conductive traces to electrically connect the bottom contacts with appropriate contacts on the printed circuit board. The connector is held compressed against the elastomeric material by a compressive force, typically generated by the portion of the housing in which the LCD is mounted. It is common to apply an adhesive to hold the connector secure onto the LCD. The use of conductive elastomers and adhesives adversely affects the ease and cost of manufacturing devices, such as portable hand held electronic devices that have visual displays, such as cellular telephones.

SUMMARY OF THE INVENTION

The electrical connector of the present invention includes an insulative body comprising a first portion and a second portion extending generally perpendicularly from the first second portion. The connector also includes a conductive means comprising a retention section and a resilient section. The conductive means is retained by the second portion of the insulative body and the resilient section extending adjacent the first portion of the insulative body. The connector may be interposed between a planar electrical device and a printed circuit board.

BRIEF DESCRIPTION OF THE DRAWINGS

The electrical connector of the present invention is further described with reference to the accompanying drawings in which.

DETAILED DESCRIPTION OF THE PREFERRED EMBODIMENTS

The invention will be described in the context of a connector specifically adapted for electrically connecting planar electrical devices, such as LCD's, to another circuit board. However, the invention is believed to have applicability in other connectors.

Figure 1:
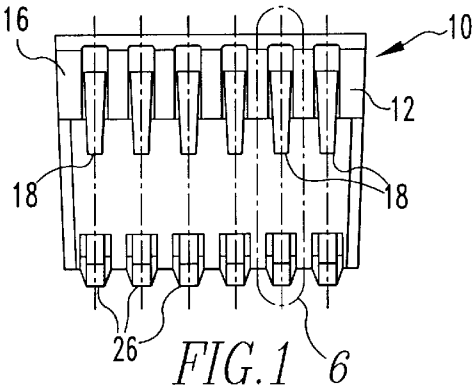
FIG. 1 is a front elevational view of a connector embodying the invention.
Figure 2:
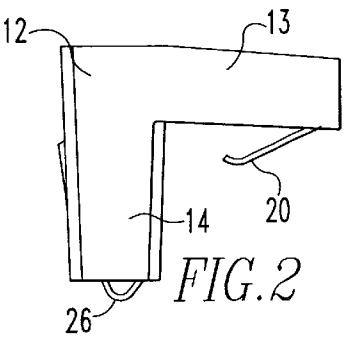
FIG. 2 is a side elevational view of the connector shown in FIG. 1.
Figure 3:
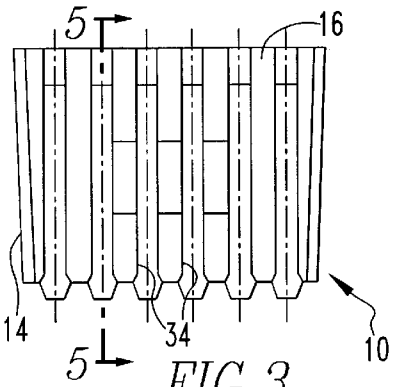
FIG. 3 is a back elevational view of the connector shown in FIG. 1.
Figure 4:
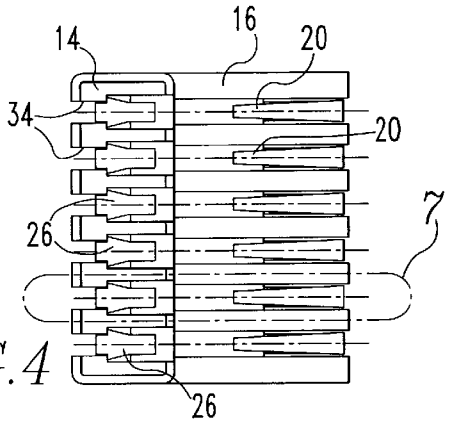
FIG. 4 is a bottom view of the connector shown in FIG. 1.

FIG. 1 shows a connector 10 having a body 12 formed of a molded polymeric insulating material. The body 12 includes a vertically extending leg portion 14 and a generally horizontally extending top portion 16. The connector also includes a plurality of suitable conductive metal terminals 18, preferably formed by stamping.

Figure 5:
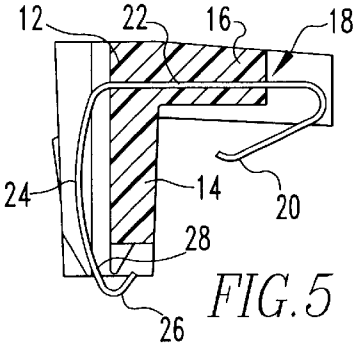
FIG. 5 is a cross-sectional view taken along line AA of FIG. 3.
Figure 6:
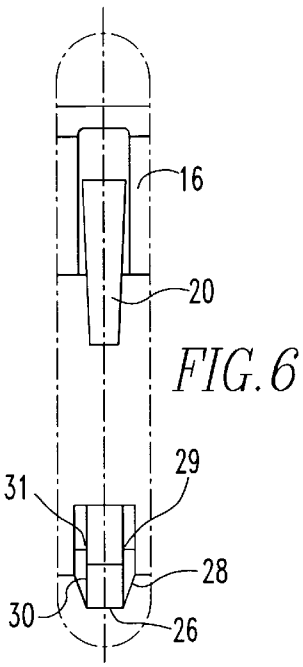
FIG. 6 is an enlarged view of area B of FIG. 1.
Figure 7:
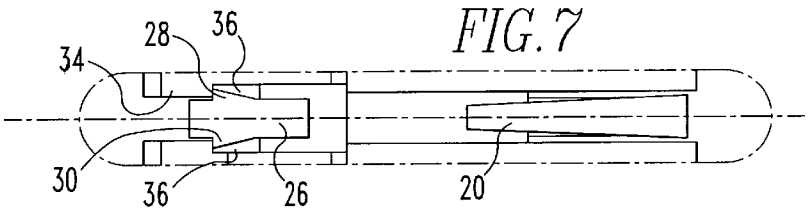
FIG. 7 is an enlarged view of area C of FIG. 4.

Each terminal 18 includes a cantilevered spring contact portion 20 for engaging an electrical device, as will later be described. Terminals 18 further include a retention portion 22 (FIG. 5), where the terminal 18 is retained in the body 12. Each terminal further includes a downwardly extending resilient beam portion 24 extending along the rear of the body 12. As will later be described, the portion 24 generally forms a Euler's Beam structure. At the bottom of each terminal 18 is a PCB contact portion 26 for engaging contact pads on a printed circuit board, as will later be explained. As can be seen in FIG. 5, the PCB contact section 26 is formed as a curved surface having an outside radius that contacts the printed circuit board. Adjacent the contact portion 26 is an opposed pair of retention ears 28 and 30 (FIG. 7), the upper portions 29 and 31 (FIG. 6) of which are bent inwardly to form radiused surfaces, such as surface 32 (FIG. 8*d*).

As shown in FIGS. 3, 4 and 8*a*–*f*, grooves 34 are formed in the back of the housing 12 for receiving the portions 24 of beams 18. Additionally, undercut portions 36 are formed in opposing relationship in each groove 34. The undercut portions 36 form shoulder surfaces 38 that are designed to engage the surfaces 32 of terminal 18, as will later be described.

Figure 8A:
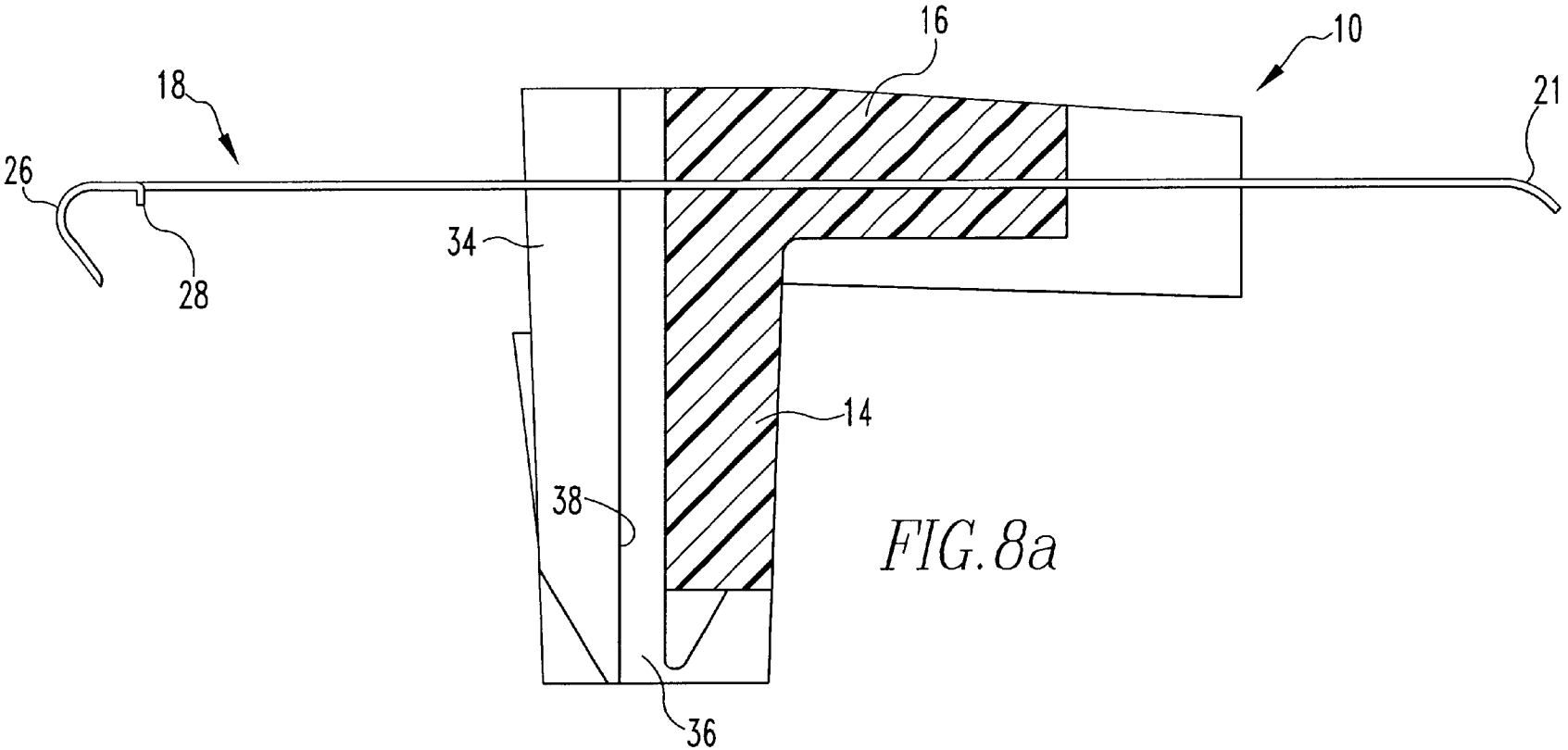
FIGS. 8*a*–8*f* are sequential illustrations of manufacturing and installation steps related to the connector of FIG. 1.

In FIG. 8*a*, the connector 10 is shown in a intermediate stage of manufacture. In this stage, an array of terminals 18 in coplanar, side-by-side relationship may be formed by stamping from terminal sheet stock. As shown in the figure, the ends of the terminals 18 have been preliminarily bent to form the contact portion 21 of the cantilevered spring arm 20 and the printed circuit board contact portion 26. The connector body 12 is preferably formed by overmolding or insert molding the connector body 12 onto the array of terminals 18, so that the terminals are securely held in the body 12.

Figure 8B:
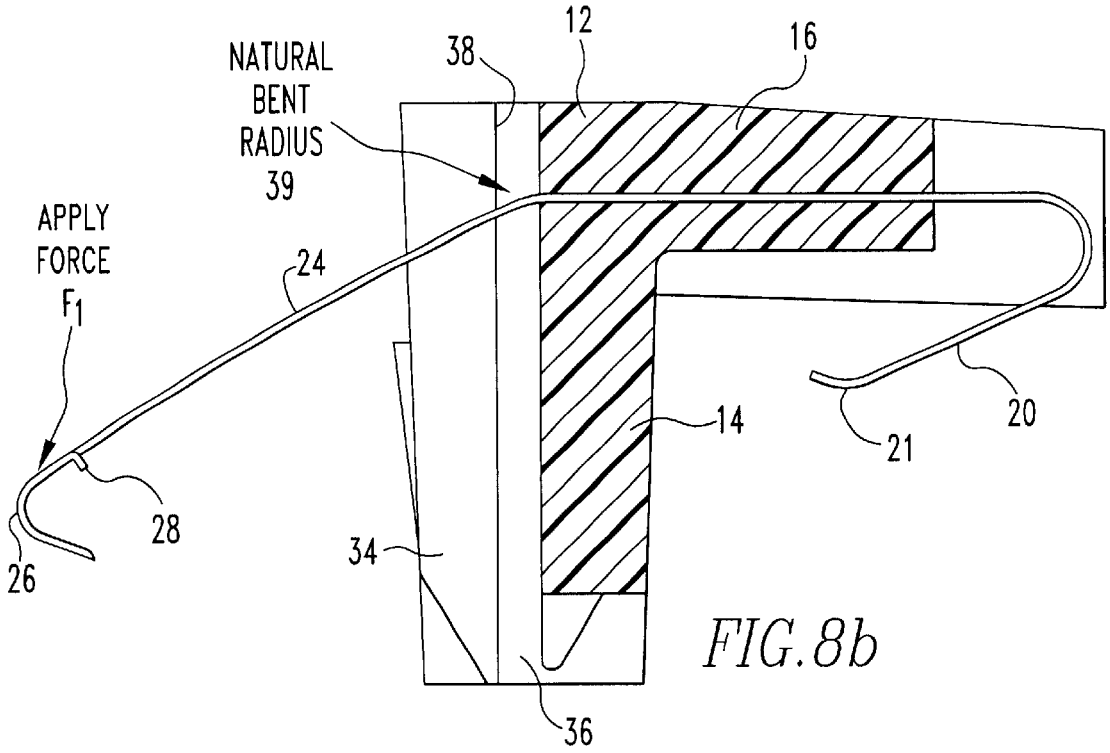
Figure 8D:
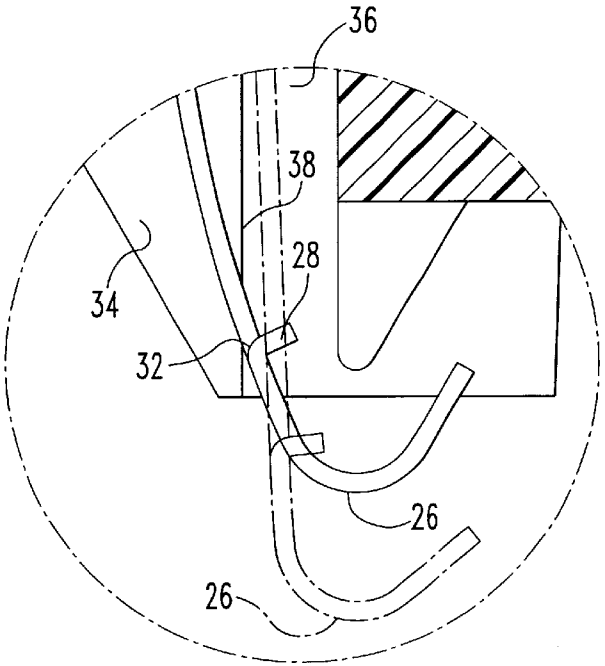
Figure 8C:
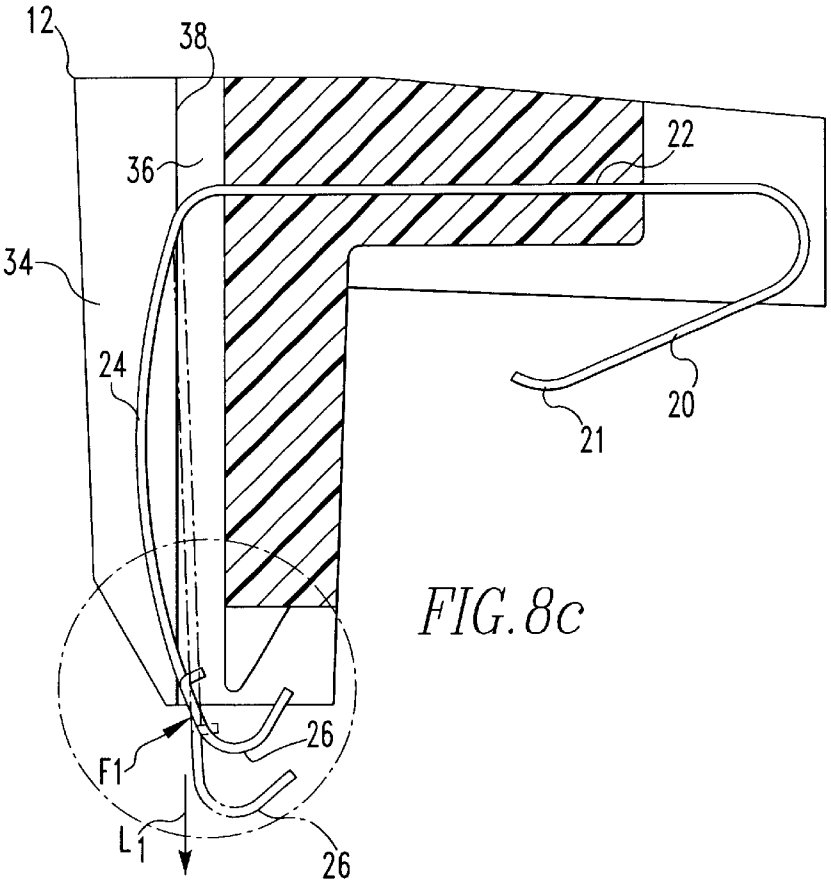

Referring to FIG. 8*b*, the cantilevered spring portion 20 has been formed by bending. Also, the beam portion 24 is formed by applying a force in the direction of arrow F1 at or near the tip of the section 24 to bend the section 24 about a bend radius formed generally in the area of region 39. Eventually, the beam portion 24 is bent toward the full line portion shown in FIG. 8*c*. At this time, force F1 is maintained on the end of the beam 24. At the same time, a force F2 is applied to the mid-section of the beam to extend the length of the beam to position the tip section 26 toward the dotted line position shown in FIGS. 8*c* and 8*d*. At this time, the surface 32 of each of the ears 28, 30 is positioned in general alignment with the shoulder surfaces 38. After the force F2 is removed, the beam retracts so that the surfaces 32 of the ears 28, 30 are retained against the shoulder surfaces 38. In this manner, the portion 26 is located and a desired amount of preload is imparted on it.

The terminal section 24 operates generally in the manner of a Euler's buckling beam whereby, as the beam is buckled, it changes length. That is, when a force the direction of arrow F2 is applied, the beam lengthens in the direction of arrow L1. Conversely, when the force F2 is removed, the spring force in the beam returns the beam to its original shape, thereby shortening the length of the beam and raising the contact section 26 toward the connector body 12.

Figure 8E:
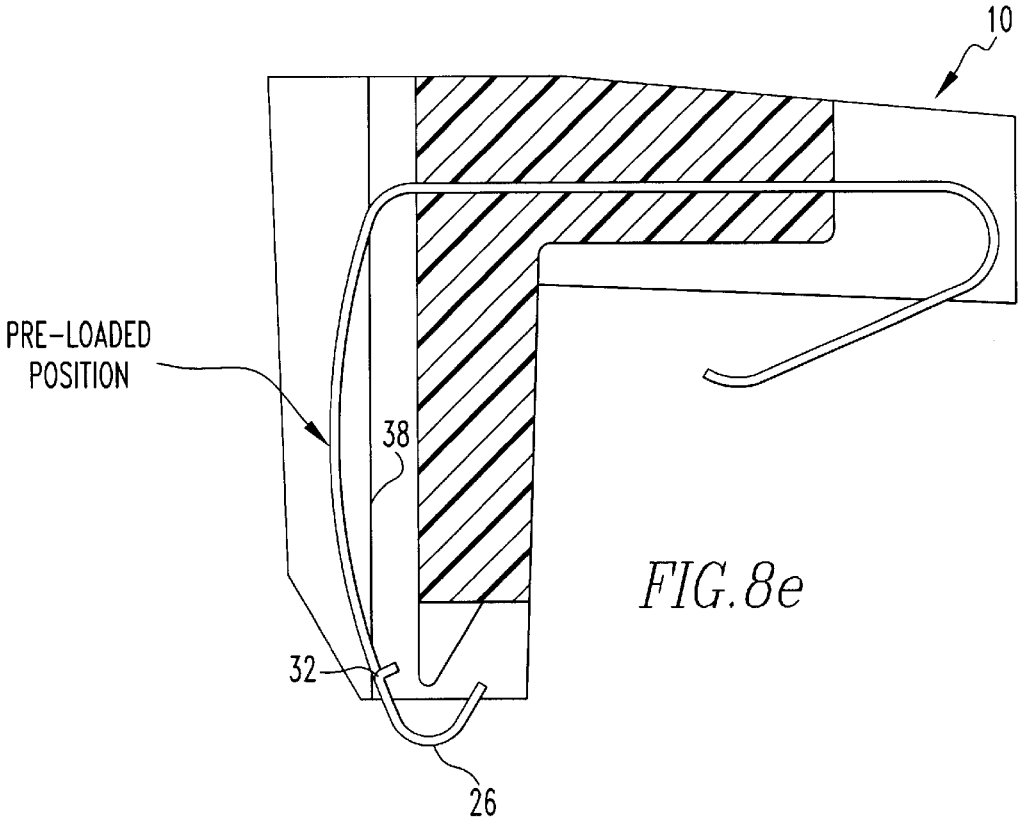
Figure 8F:
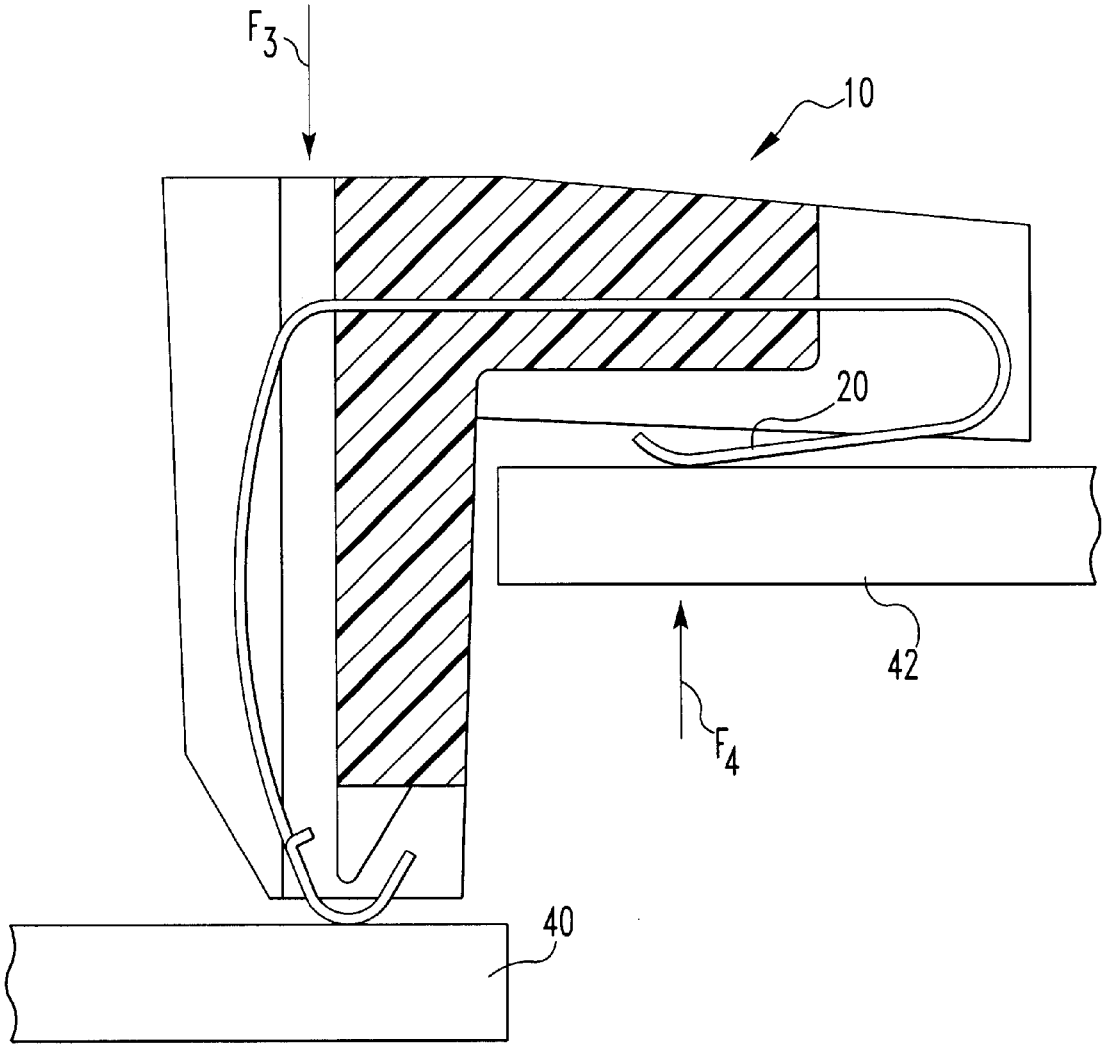

FIG. 8*e* shows the connector 10 substantially in a rest position, with the printed circuit board contact portion 26 extending beneath the housing. FIG. 8*f* shows the connector in mated condition, wherein a force in the direction of arrow F3 holds the connector 10 against the substrate 40 causing the beam 24 to be buckled. The resulting deflection generates a normal force pressing contact portion 26 against PCB 40. In addition, a force applied in the direction of arrow F4 to the LCD 42 causes the contact section 20 to deflect, thereby generating a normal force pressing contact portion 21 against LCD 42.

Figure 9A:
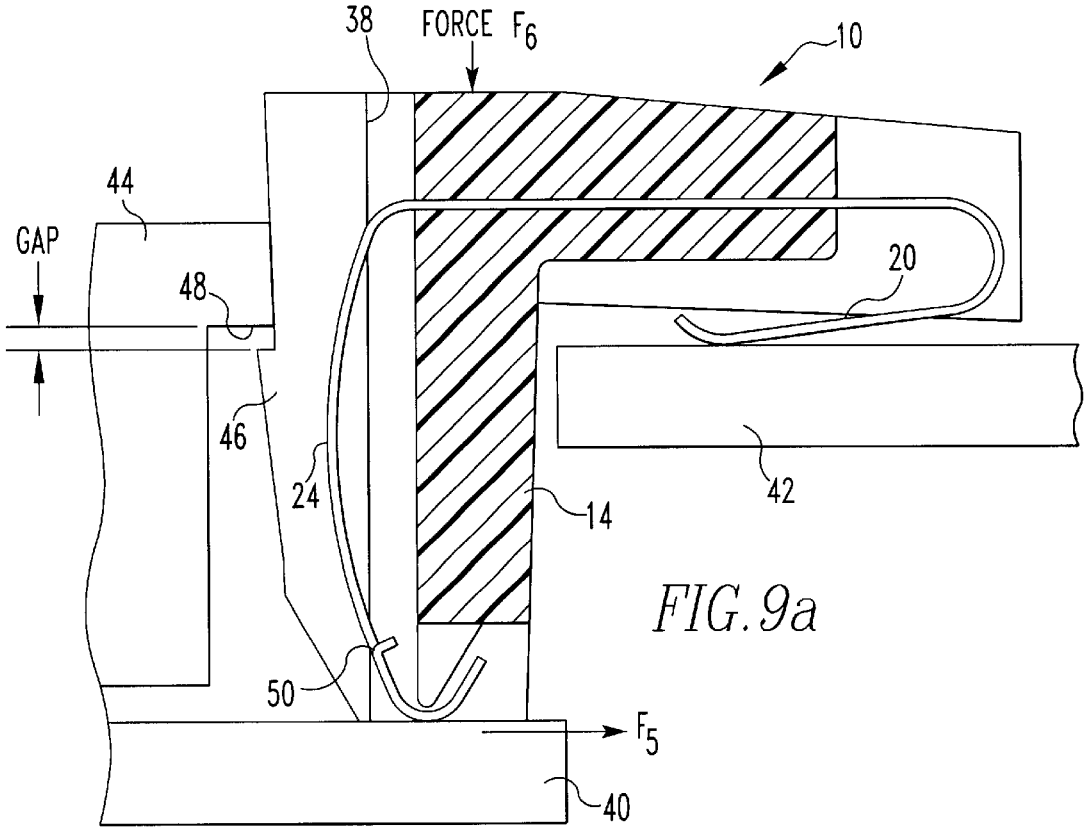
FIGS. 9*a* and 9*b* show positions of the connector of FIG. 1 during application and use.
Figure 9B:
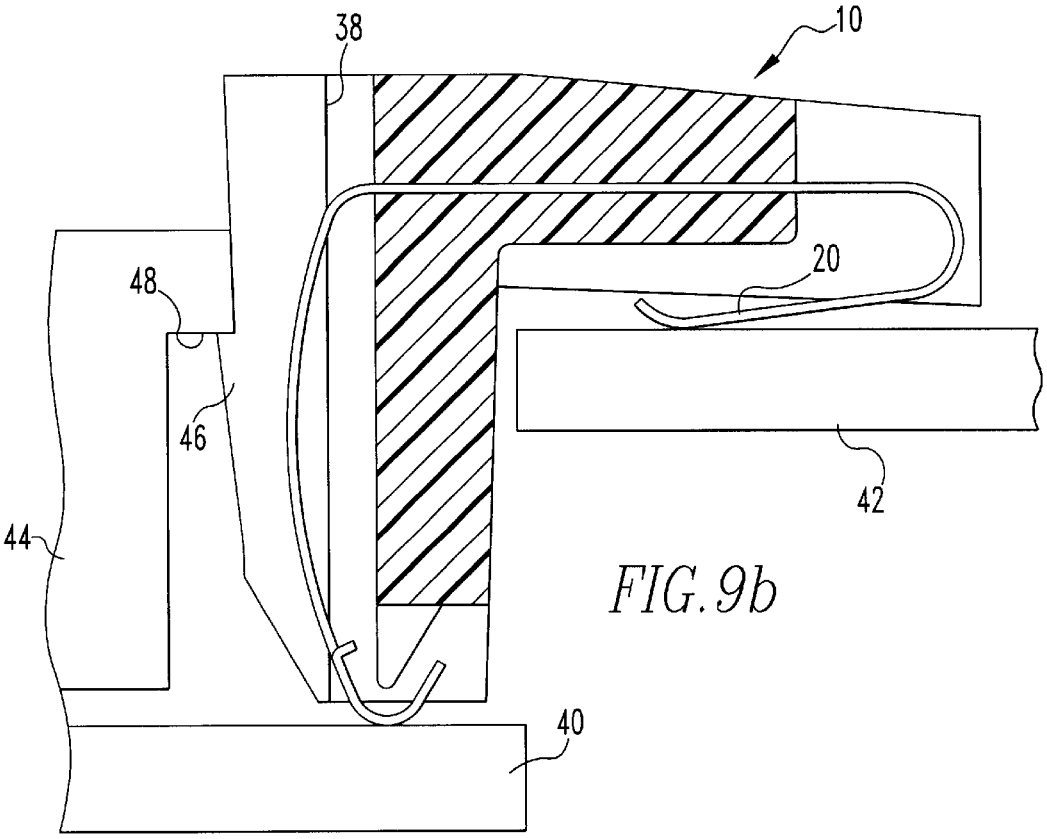

As shown in FIG. 9*a,* in a typical application, a frame 44 is provided to support the LCD 42 and the connector 10. In this arrangement, the LCD 42 is supported on portions (not shown) of the frame 44 and the connector 10 is inserted into the frame 44 by pushing the leg 14 of the connector through an aperture or recess in the frame 44. To accomplish this, a force in the direction of arrow F6 is placed on the connector 10 to insert the connector into the frame. In doing so, a retention tang 46 formed on the back of the connector body 12 is forced past the retention edge 48 of the opening. In this condition, the cantilevered beam contact 20 and the buckling beam 24 are deflected to a maximum extent, as the bottom edge of the connector is pressed against the surface of the printed circuit board 40. This figure also illustrates the action of the connector if, after assembly, a downward force is applied to the connector/LCD assembly, as by pressing downwardly on the LCD. An advantage of this construction is that the electrical connection at the level of contact portion 26 is maintained, even though a relatively high compressive force is repeatedly applied to connector 10. FIG. 9*b* shows the final mated position of the connector 10 wherein the retention tang 46 is retained against the surface 48 and the connector 10 has moved upward slightly away from the PCB 40, as a result of the spring force in beam 24.

It is to be further noted that the printed circuit board contact portion 26 undergoes a wiping and rolling action during this operation, to effect proper electrical connection with contact pads on PCB 40. This occurs as a result of the imposition of a vertical force on the beam section 24, which causes the section 26 to move along the surface of PCB 40 in the direction of arrow F5 (FIG. 9*a*). As this occurs, the contact portion 26 also rotates about a contact point between radius 32 and shoulder surface 38.

The connector disclosed has many advantages. The Euler's buckling beam arrangement provides a relatively long spring travel using only a small area of the footprint of the connector. It also provides simplified locating and preloading of the contact portion 26. It further allows a contact wiping and cleaning action, thereby providing good contact. Further, this approach eliminates the need for conductive elastomeric members between the connector and the PCB.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of providing an electrical connection between a planar electrical device having an upper and a lower surface and a printed circuit board having an upper and a lower surface comprising:

(a) providing an insulative body comprising a leg portion having a rear side and a lower end and a top portion having a front end and extending generally perpendicularly from said leg portion to said front end, and fixing a conductive element in generally parallel relation to the top portion;

(b) bending the conductive element adjacent the front end of the top portion downwardly and rearwardly to form a cantilevered spring contact generally beneath the top portion;

(c) bending the conductive element downwardly to form a resilient section having a terminal contact adjacent the leg portion of the insulative body and fixing said resilient section of said conductive element to said leg portion adjacent said terminal contact;

(d) then positioning the insulative body and the conductive element such that a lower surface of the top portion of the insulative body is superimposed over the upper surface of the planar electrical device so that the cantilevered spring contact engages the upper surface of the planar electrical device and the lower end of the leg portion is superimposed over the upper surface of the printed circuit board so that the terminal contact of the resilient section engages the printed circuit board.

2. The method of claim 1 wherein the conductive element has a bend radius adjacent the rear side of the leg portion, and in step (c) a first force is exerted rearwardly and axially on the conductive element while the conductive element is bent downwardly about said bend radius.

3. The method of claim 2 wherein in step (c) a second force is applied transversely to the conductive element between the bend radius and the printed circuit board to cause the terminal contact to be depressed below the lower end of the leg portion of the insulative body.

4. The method of claim 3 wherein in step (d) a third force is applied downwardly to hold the terminal contact against the upper surface of the printed circuit board.

5. The method of claim 4 wherein in step (d) a fourth force is applied upwardly to hold the upper surface of the electrical device against the cantilevered spring contact.

6. The method of claim 5 further comprising a step of providing a frame having a retention surface adjacent to the rear side of the leg portion of the insulative body, the rear side of the leg portion of the insulative body further comprising a retention tang, and a force is applied downwardly on the insulative body to allow said retention tang to be depressed below the retention surface of the frame after which said force is released to allow said retention tang to come to rest against the retention surface of the frame.

7. The method of claim 1 wherein the conductive element is a conductive metal terminal.

8. The method of claim 4 wherein the conductive metal terminal is stamped.

9. The method of claim 1 wherein in step (d) the lower surface of the top portion of the insulative body is superimposed in spaced relation over the upper surface of the planar electrical device.

10. The method of claim 1 wherein in step (d) the lower end of the leg portion of the insulative body is superimposed over the upper surface of the printed circuit board.

11. A method of electrically connecting a planar electrical device, having an upper surface, and a circuit substrate, having an upper surface, comprising the steps of:

providing an electrical connector, comprising:

a generally L-shaped insulative body, having:

a leg portion with a lower end and a top end; and a top portion extending transversely from said top end of said leg portion, said top portion including a front end; and a conductive element with first and second opposite ends;

fixing said conductive element to said top portion so that said first and second ends are cantilevered from said top portion;

bending said first end beneath said top portion;

bending said second end so that said conductive element extends along said leg portion;

fixing said second end to said lower end of said leg portion;

positioning said top portion above said upper surface of said electrical device so that said first end of said conductive element engages said upper surface of said electrical device; and positioning said lower end of said leg portion above said upper surface of said circuit substrate so that said second end of said conductive element engages said upper surface of said circuit substrate.

12. The method as recited in claim 11, wherein the second end fixing step includes the step of forming a resilient section on said conductive element adjacent said leg portion.

13. The method as recited in claim 12, further comprising the step of flexing said resilient section.

14. The method as recited in claim 13, wherein the flexing step occurs either simultaneous with, or after, the top portion positioning step and the lower end positioning step.

15. The method as recited in claim 11, wherein the conductive element fixing step comprises extending said conductive element through said top portion.

16. A method of making an electrical connection between a planar electronic device and a circuit substrate, comprising the steps of:

providing an electrical connector, including:

an insulative body, having:

a leg portion with a rear side and a lower end; and a top portion extending transversely from said leg portion, said top portion having a front end and a rear end, said rear end adjacent said leg portion;

a conductive element, having:

a first end; and a second end;

placing said conductive element in said top portion so that said first end of said conductive element extends from said front end of said top portion and said second end of said conductive element extends from said rear end of said top portion;

bending said first end of said conductive element downwardly and rearwardly from said front end to form a cantilevered spring contact generally beneath said top portion;

bending said second end of said conductive element downwardly to extend adjacent said leg portion; and fixing said second end of said conductive element to said lower end of said leg portion.

17. The method as recited in claim 16, wherein the second end fixing step includes the step of forming a resilient section on said conductive element adjacent said leg portion.

18. The method as recited in claim 17, further comprising the step of flexing said resilient section.

19. The method as recited in claim 16, wherein the conductive element placing step comprises overmolding said top portion about said conductive element.

20. The method as recited in claim 16, wherein the second end fixing step comprises abutting said second end with a shoulder on said leg portion.

* * * * *